US008500418B2

(12) United States Patent
Haynes et al.

(10) Patent No.: US 8,500,418 B2
(45) Date of Patent: Aug. 6, 2013

(54) INTERNALLY SUPPLIED AIR JET COOLING FOR A HYDRAULIC PUMP

(75) Inventors: Joseph Haynes, Rockford, IL (US); Dwight Booth, Milton, WI (US)

(73) Assignee: SPX Corporation, Charlotte, NC (US)

( * ) Notice: Subject to any disclaimer, the term of this patent is extended or adjusted under 35 U.S.C. 154(b) by 213 days.

(21) Appl. No.: 12/914,069

(22) Filed: Oct. 28, 2010

(65) Prior Publication Data

US 2012/0107142 A1 May 3, 2012

(51) Int. Cl.
*F04B 39/06* (2006.01)
*F01B 31/16* (2006.01)

(52) U.S. Cl.
USPC ..... 417/313; 60/685

(58) Field of Classification Search
USPC ..... 417/313, 375; 60/516, 685, 697
See application file for complete search history.

(56) References Cited

U.S. PATENT DOCUMENTS

| | | | | |
|---|---|---|---|---|
| 2,036,556 | A | 4/1936 | Tomlinson | |
| 2,347,100 | A | 4/1944 | Grocott | |
| 2,812,895 | A * | 11/1957 | Peeps | 137/899.4 |
| 2,938,347 | A | 5/1960 | Sturgis | |
| 4,662,551 | A * | 5/1987 | Dudley et al. | 224/633 |
| 6,942,464 | B2 | 9/2005 | Brashears et al. | |
| 7,255,540 | B1 | 8/2007 | Cooper | |
| 7,798,134 | B2 | 9/2010 | Marsh | |
| 2009/0145680 | A1 | 6/2009 | Wilson | |

OTHER PUBLICATIONS

International Search Report of PCT/US2011/056700 filed Oct. 18, 2011 in the name of: SPX Corporation.
The International Preliminary Report on Patentability and Written Opinion of the International Searching Authority dated Apr. 30, 2013.

* cited by examiner

*Primary Examiner* — Charles Freay
(74) *Attorney, Agent, or Firm* — Baker & Hostetler LLP

(57) ABSTRACT

A compressed gas powered machine is provided. The machine includes: an outlet and a hollow member fluidly connected to the outlet and configured to receive gas expended from the machine through the outlet the hollow member defining holes oriented to allow the gas contained in the hollow member to blow on various parts of the machine.

19 Claims, 10 Drawing Sheets

INTERNALLY SUPPLIED AIR JET COOLING FOR A HYDRAULIC PUMP

FIELD OF THE INVENTION

The present invention relates generally to a cooling system for a pneumatic piece of machinery. More particularly, the present invention relates to a system using the exhaust gas from a pneumatic machine to cool the machine.

BACKGROUND OF THE INVENTION

High performance hydraulic pumps have the ability to generate extra work compared to standard pumps. Some of the unused work from a high performance hydraulic pump is converted to heat. The resulting heat may be transferred to components of the hydraulic system. In some instances, it is undesirable that operators of the system be exposed to the heated components. Further, even if operators of the system are not exposed to heated elements, heating the elements may cause undesirable results.

Some high performance hydraulic pumps are pneumatically operated. After the compressed air is used to drive the motor it may still be at a higher pressure than the ambient or atmospheric air, thus the exhaust air is pressurized when it is vented to the outside. The exhaust air cools as it expands when reaching the ambient pressure.

Pneumatic hydraulic pumps sometimes incorporate electrically operated fans to cool them, however, this requires both a pneumatic connection and electric connection to the pump. It would be desirable to provide a hydraulic pump that has fewer connections and/or no need for electrical power to cool the hydraulic pump, but yet performs the same functions of a typical hydraulic pump.

SUMMARY OF THE INVENTION

The foregoing needs are met, to a great extent, by embodiments in accordance with the present invention. Wherein, in one aspect an apparatus is provided that provides cooling for heated components of the hydraulic pump without requiring electric fans to accomplish the cooling.

In accordance with one embodiment of the present invention, a compressed gas powered machine is provided. The machine includes: an outlet and a hollow member fluidly connected to the outlet and configured to receive gas expended from the machine through the outlet the hollow member defining holes oriented to allow the gas contained in the hollow member to blow on various parts of the machine.

In accordance with another embodiment of the present invention, a method of cooling a machine may also be provided. The method may include; outputting a compressed gas from the machine into a hollow member, directing the gas to a desired location, and venting the gas onto various components desired to be cooled.

In accordance with yet another embodiment of the present invention, a compressed gas powered machine is provided. The machine may include; a means for outletting a gas; and a means for directing a gas flow fluidly connected to the outletting means and configured to receive gas expended from the machine through the outletting means, the directing means defining holes oriented to allow the gas contained in the directing means to vent on features desired to be cooled.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

A cooling system for a pneumatic piece of equipment will now be described. In some embodiments of the invention, compressed air after it has been used to run a pneumatic machine is still at a higher pressure than ambient or atmospheric air in the environment in which the machine dwells. Thus, when the pneumatic air has operated the machine and is output to the atmosphere it expands and cools. Furthermore, rapid expansion of this air can be noisy. Suppression of this noise in some instances may be dealt with by using a muffler. In order to utilize the cooling of the exhaust gas as it expands to atmospheric pressure some embodiments of the invention include cooling parts of the pneumatic machine by expanding the exhausted compressed air and directing it on various parts of the pneumatic machine.

These cooling functions in typical machines may be accomplished by the use of electric powered devices such as fans and the like. Some embodiments may eliminate the need for electric power source for some pneumatic powered machines. Other pneumatic powered machines in accordance with the invention may still use electric power for some functions. While the pneumatic machine described herein is a hydraulic pump, the invention is not limited to hydraulic pumps, principles in accordance with the invention may be applied to other pneumatic machines. The hydraulic pumps shown described below are meant to be exemplary only and do not limit the scope of the invention in any way.

Figure 1:
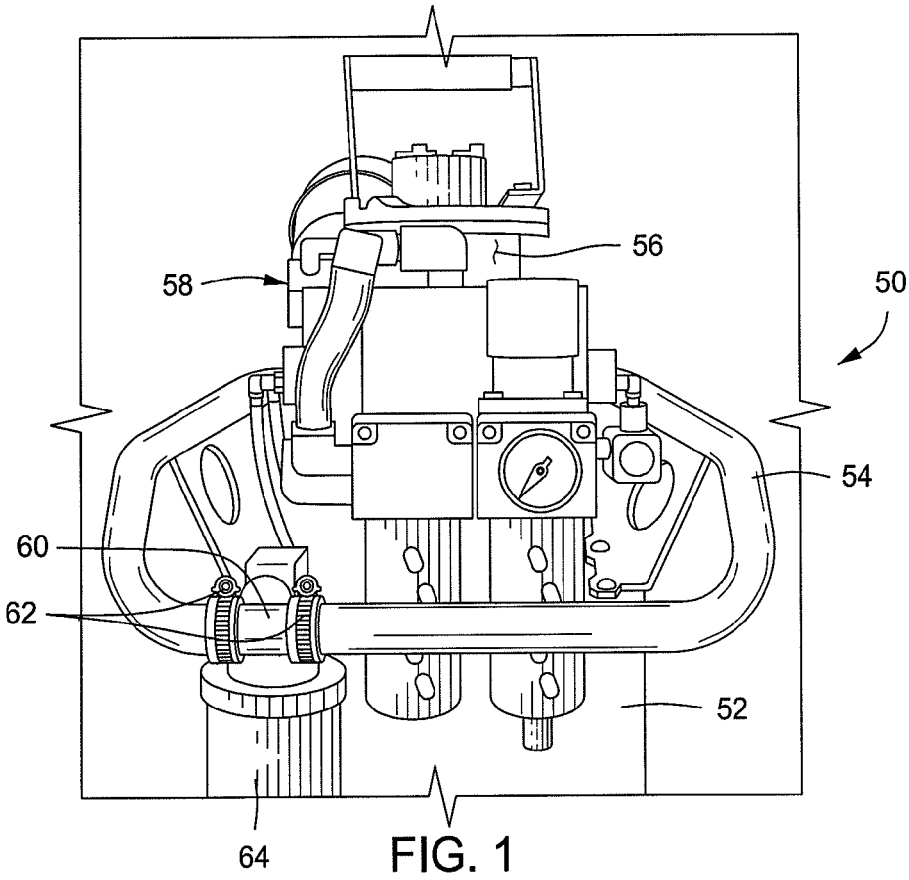
FIG. 1 is a front view of a hydraulic pump in accordance with an embodiment of the invention.

FIG. 1 shows a pneumatic hydraulic pump 50 in accordance with an embodiment of the invention. The hydraulic pump 50 includes a base 52. The hydraulic pump 50 also includes roll bars 54. The roll bars 54 surround the motor 56 and related components of the hydraulic pump 50 and may provide some protection to the hydraulic pump 50 if tipped on to its side or is bumped by other equipment. The hydraulic pump 50 includes an outlet 58 for exhausting the compressed air (or other fluid) used to drive the pneumatic motor 56 associated with the hydraulic pump 50. The outlet 58 is connected to a fitting 60. The fitting 60 directs compressed air expelled from the outlet 58 into the hollow roll bar 54. In some instances more compressed air may be expended through the outlet 58 than is needed to cool various components of the hydraulic pump 50. In such instances, the fitting 60 may also connect to a muffler 64. The air can be expanded and expelled in the muffler 64. The muffler 64 reduces noises associated with the compressed air expanding and venting out of the outlet 58. The fitting 60 may attach the roll bar 54 by clamps 62. In some instances the clamps 62 may also serve to attach the muffler 64 to the roll bar 54.

Figure 2:
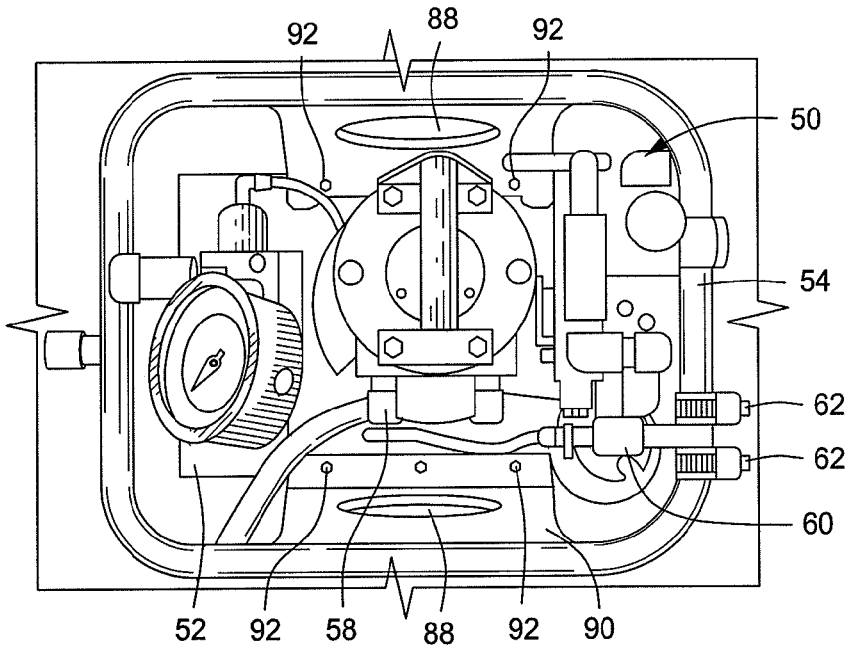
FIG. 2 is a top view of a hydraulic pump shown in FIG. 1.

FIG. 2 is the top view of a hydraulic pump 50 in accordance with an embodiment of the invention. As shown in FIG. 2 hydraulic pump 50 includes a fitting 60 connected to roll bar 54 via clamps 62. FIG. 2 also shows how the roll bar 54 attaches to the base 52. The roll bar 54 includes attaching plates 90. The attachment plates 90 may include holes 88. The attaching plates 90 may be attached via fasteners 92 to the base 52.

Figure 3:
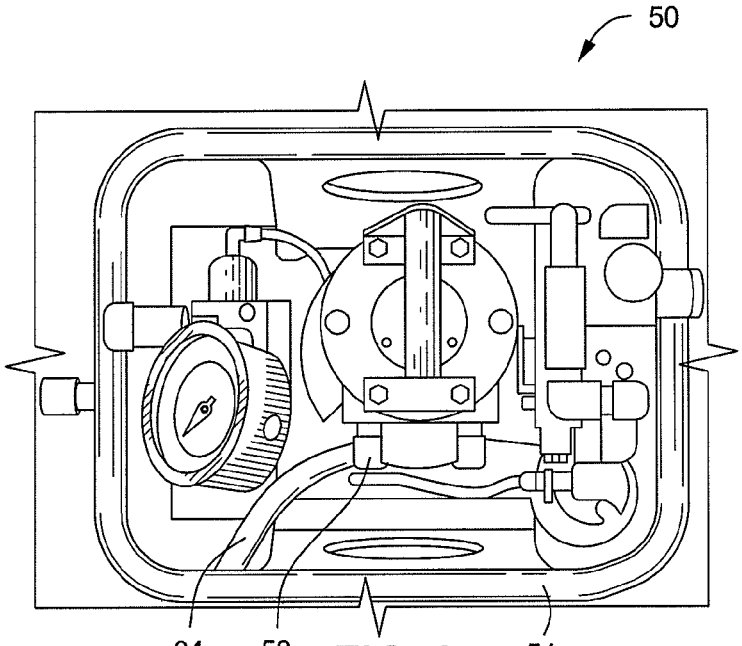
FIG. 3 is a top view of a hydraulic pump in accordance with an embodiment of the invention.
Figure 4:
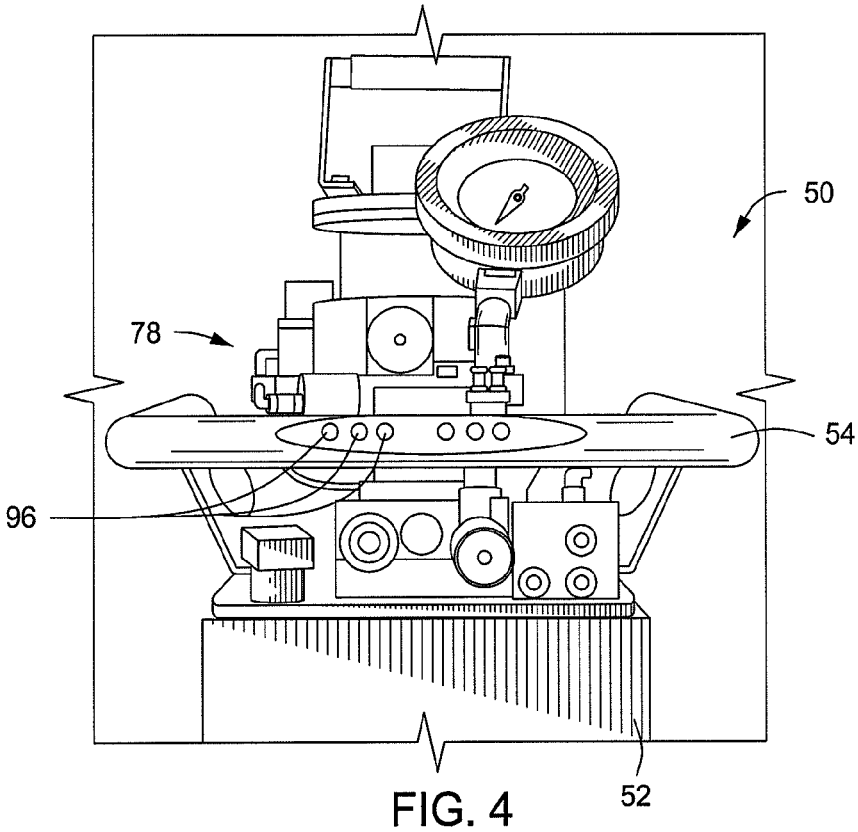
FIG. 4 is a rear view of a hydraulic pump in accordance with an embodiment of the invention.

Another embodiment in accordance to the invention is shown in FIG. 3. FIG. 3 is a top view of a hydraulic pump 50. As shown in FIG. 3, the outlet 58 may attach to a hose fitting 94 which allows the expended gas coming out of the outlet 58 to be directed into the roll bar 54. The hose fitting 94 may be flexible or may be a rigid member depending on the individual needs of a particular application. FIG. 4 shows another embodiment in accordance with the invention. The hydraulic pump 50 includes the roll bar 54 sitting on top of a base 52. Holes 96 in the roll bar 54 are shown in broken lines indicating that the holes 96 are oriented on the opposite side of the roll bar 54 than what can be seen in FIG. 4 and thus face the components 78 of the hydraulic pump 50 upon which cool air is desired to be blown.

Figure 5:
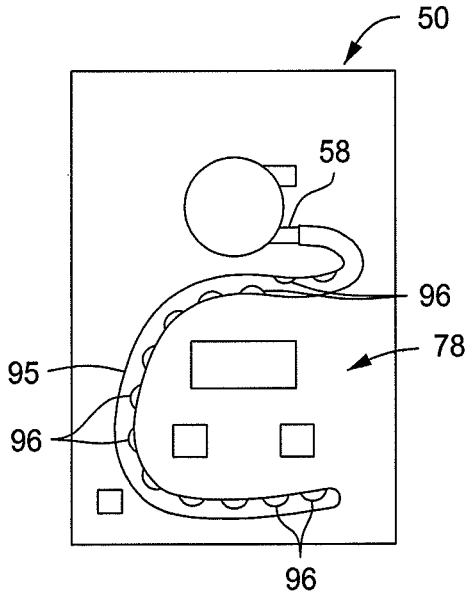
FIG. 5 is a top view of a schematic diagram of a hydraulic pump in accordance with an embodiment of the invention.

FIG. 5 shows an alternate embodiment of a hydraulic pump 50. The hydraulic pump 50 is shown in FIG. 5 as a top view and is a schematic diagram. The outlet 58 is connected to a flexible hose 95. In some embodiments, a rigid tube may be used. The flexible hose 95 has holes 96 oriented towards components 78 of the hydraulic pump 50 that are desired to be cooled. Gas exiting the outlet 58 expands and is thereby cooled. This cooled gas flows through the flex hose 95 and flows out of the holes 96, thereby cooling the components 78 of the hydraulic pump 50.

Figure 6:
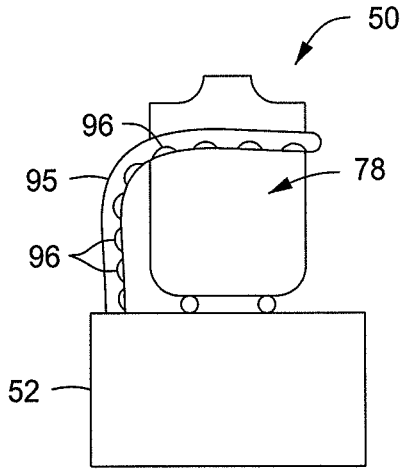
FIG. 6 is a front view of a hydraulic pump in accordance with an embodiment of the invention.

FIG. 6 is a side view of the embodiment shown in FIG. 5. The hydraulic pump 50 is equipped with a flex hose 95 having holes 96 oriented towards components 78 of hydraulic pump 50 that are desired to be cooled by gas flowing out of the holes 96 and onto the components 78 of the hydraulic pump 50. The hydraulic pump 50 sits upon the base 52. In some embodiments of the invention the flex hose 95 may not necessarily be a flexible but could also be a rigid component placed in the orientation desired. In other embodiments of the invention feature 95 may be flexible hose and can be oriented to multiple orientations as desired by a user. The embodiments shown in FIGS. 5 and 6 may or may not be used along with a roll bar 54.

Figure 7:
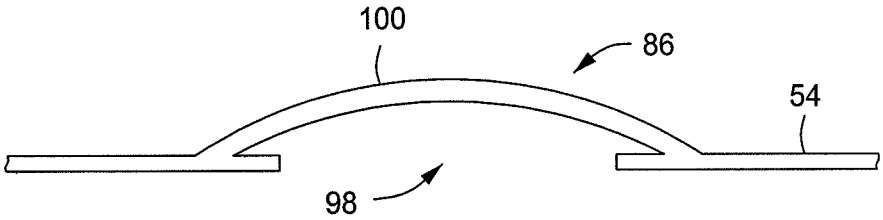
FIG. 7 is a top view of a portion of a roll cage used in a hydraulic pump.
Figure 8:
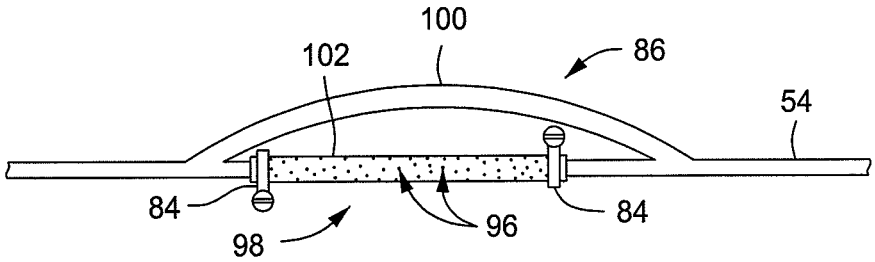
FIG. 8 is a top view of a portion of a roll cage used in a hydraulic pump.

FIGS. 7 and 8 show another embodiment in accordance with the invention. In some embodiments it may be desirable for the roll bar 54 to be modified to include a hand hold 100. The hand hold 100 may be dimensioned to be structurally strong enough to provide a point for a user to grab a hold of and lift or move the hydraulic pump 50. As shown in FIG. 7 a hand hold area 86 of the roll bar 54 is shown. The roll bar 54 includes a break 98. A hand hold bypass 100 bypasses the break 98 and connects or makes continuous the roll bar 54. The hand hold 100 may be dimensioned to be strong enough to allow a user to grab the hand hold 100 and lift or move the hydraulic pump 50.

In some embodiments of the invention, as shown FIG. 8 a perforated tube 102 may be installed at the break 98. The perforated tube 102 may include cooling holes 96 which direct cooling air or fluid located within the roll bar 54 on to components 78 of the hydraulic pump 50 that are desired to be cooled as described above. The perforated tube 102 may be a rigid structure or may be a flex hose. The perforated tube 102 may attach to the roll bar 54 by clamps 84.

According to some embodiments of the invention, air moving through the roll bar 54 may go only through the perforated tube 102. In other embodiments air may go through both the perforated tube 102 and the hand hold 100.

Figure 9:
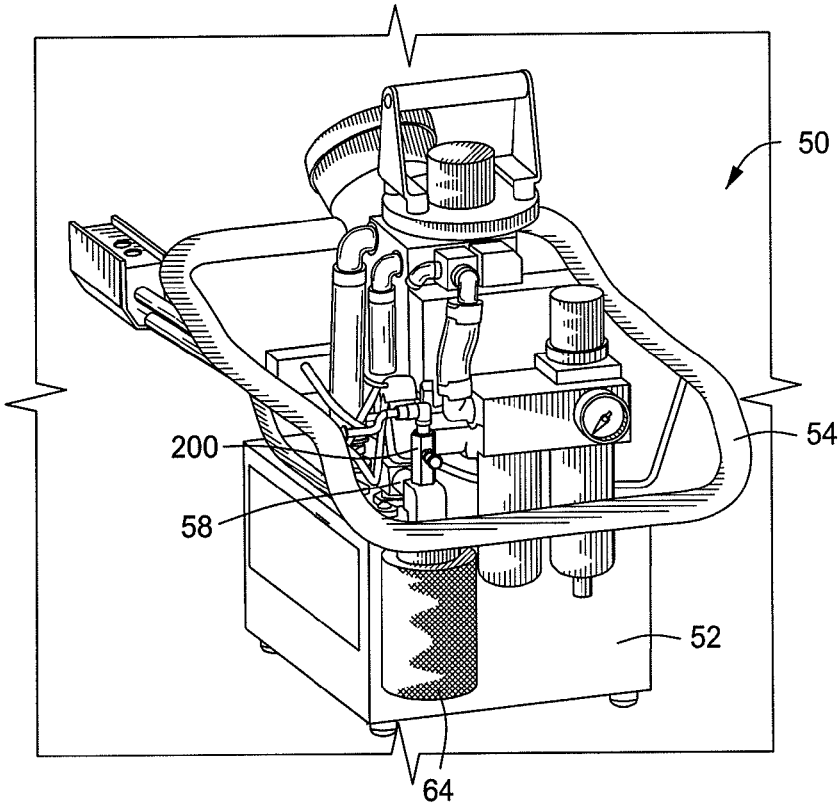
FIG. 9 is a perspective view of a hydraulic pump in accordance with an invention.

FIG. 9 shows another hydraulic pump 50 in accordance with an embodiment of the invention. The hydraulic pump 50 includes roll bars 54 surrounding a hydraulic pump 50. The hydraulic pump 50 is set upon a base 52. The outlet 58 is connected to an adjustable valve 200, which can be adjusted to allow compressed fluid flowing from the outlet 58 to either the roll bar 54, the muffler 64, or combination of the roll bar 54 and muffler 64.

Figure 10:
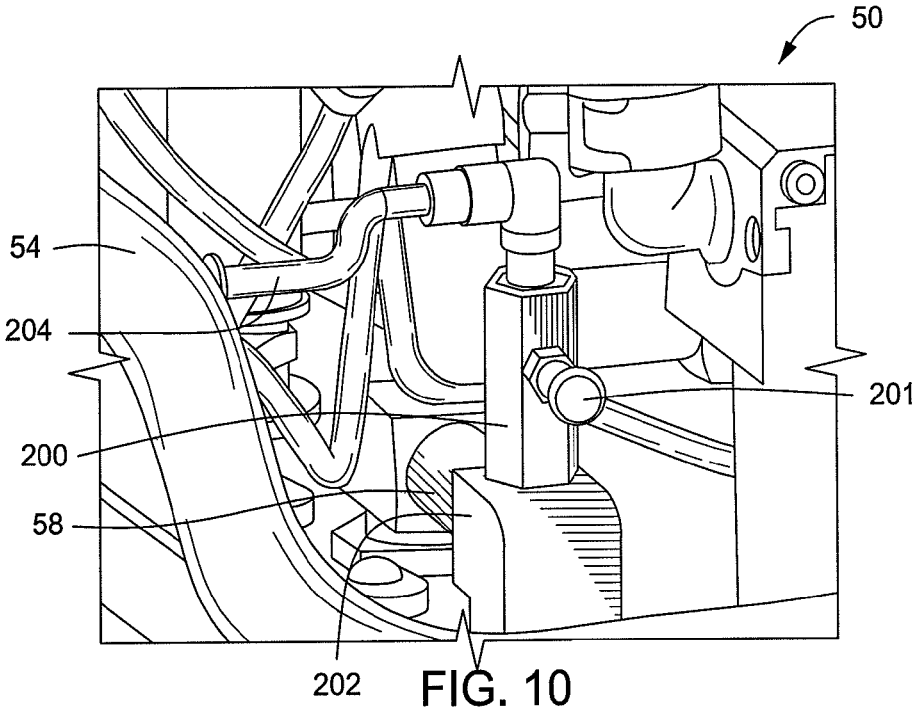
FIG. 10 is an enlarged perspective view of a portion of a hydraulic pump in accordance with an embodiment of the invention.

FIG. 10 is a close up of a portion of the hydraulic pump 50 shown in FIG. 9. The outlet 58 is shown to be fluidly connected to adjustable valve 200, to a fitting 204, and to the roll bar 54. A fitting 202 connects the outlet 58 with the muffler 64 (not shown in FIG. 10). The adjustable valve 200 is equipped with and adjusting knob 201 which allows a user to adjust how much compressed gas coming from the outlet 58 is sent to the roll bar 54 or the muffler 64.

Figure 11:
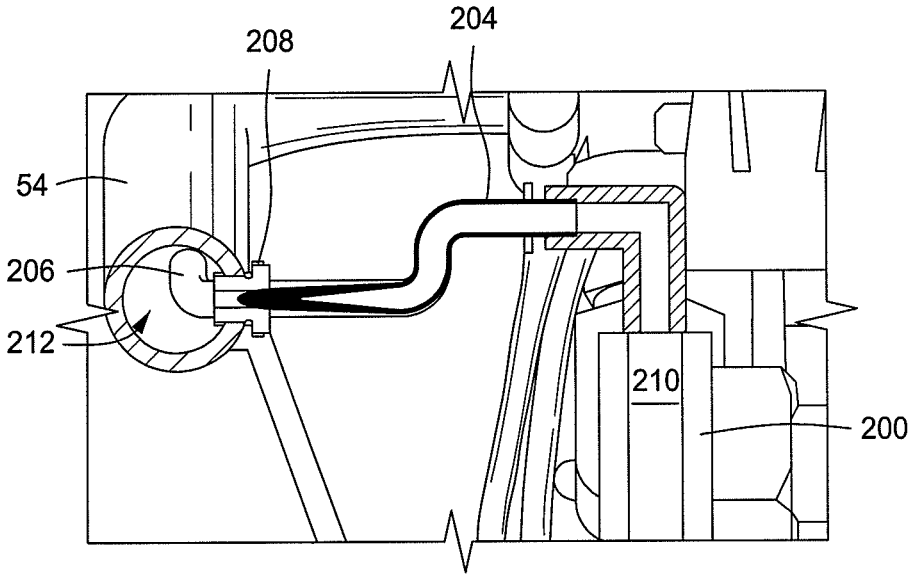
FIG. 11 is a partial cross-sectional view showing some aspects of a hydraulic pump in accordance with an embodiment of the invention.

FIG. 11 is a partial cross-sectional view of the hydraulic pump shown in FIG. 10. As shown in FIG. 11 the adjustable valve 200 includes an interior passageway which allows the compressed gas coming from the outlet 58 (not shown in FIG. 11) to flow into the fitting 204 and ultimately into the interior 212 of the roll bar 54. In some embodiments of the invention, the fitting 204 to the roll bar 54 is equipped with a strain relief 208 which helps reduce the strain on the fitting 204 to the roll bar 54. However, other embodiments in accordance with the invention may not include the strain relief 208.

As shown in FIG. 11, the passageway 210 of the adjustable value 200 and the fitting 204 to the roll bar is dimensioned to be relatively small, thus, not allowing the gases exiting through the outlet 58 to expand fully until the gases exit through the end 206 of the fitting 204 into the interior 212 of the roll bar 54.

As is well known, when compressed gases are permitted to suddenly expand they cool. Using this principle, the gases contained within the interior 212 of the roll bar 54 may be cooler than the ambient air and may be used to effectively cool various portions of the hydraulic pump 50. The fitting 204 to the roll bar 54 may be a rigid tube or may be a flexible hose.

Figure 12:
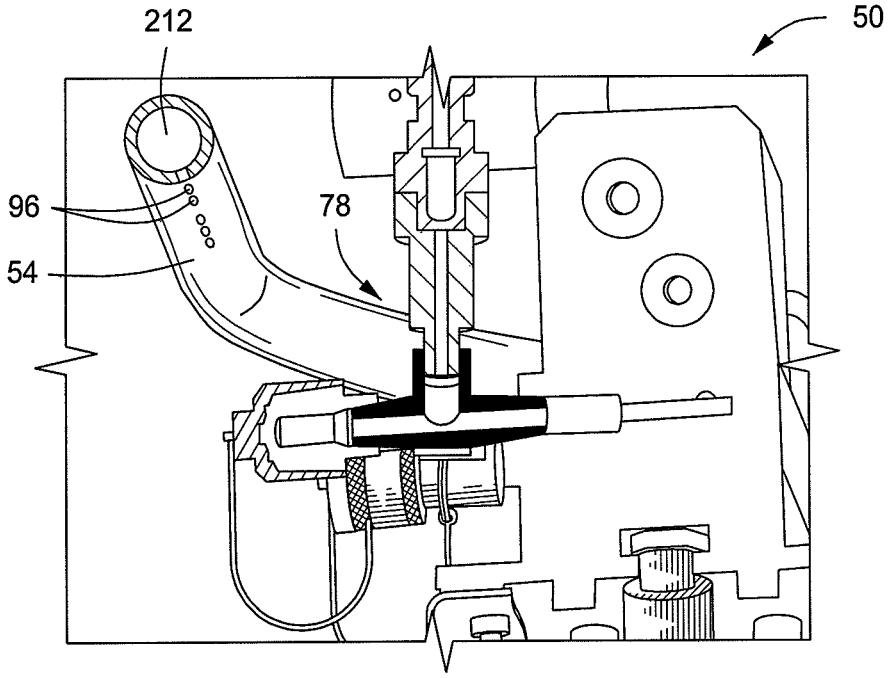
FIG. 12 is a partial cross-sectional view showing some components of a hydraulic pump in accordance with an embodiment of the invention.

FIG. 12 is a partial cross-sectional view of portions of the hydraulic pump. As shown in FIG. 12 the roll bar 54 is equipped with holes 96 oriented towards various portions 78 of the hydraulic pump 50 which are desired to be cooled. As shown the holes 96 are aligned, in other embodiments of the invention the holes 96 may not be aligned. The holes 96 provide fluid communication between the interior 212 of the roll bar 54 and the outside of the roll bar 54. Because the pressure within the interior 212 of the roll bar 54 is greater than the pressure outside the roll bar 54 the fluid contained within the interior 212 of the roll bar 54 vents or jets through the cooling holes 96 onto the portions 78 of the hydraulic pump 50 that are desired to be cooled.

Figure 13:
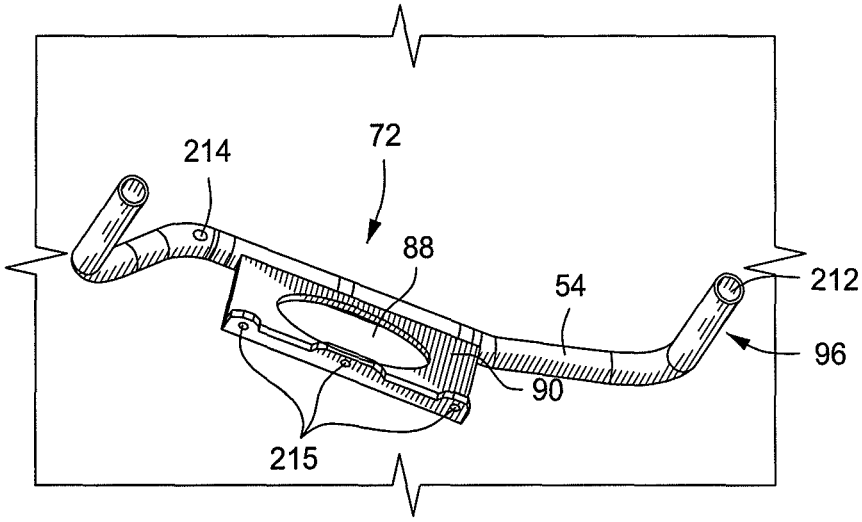
FIG. 13 is a partial cross-sectional view of a roll cage used for a hydraulic pump in accordance with some of the embodiments of the invention.

FIG. 13 is a partial cross-sectional view of the roll bar 54. FIG. 13 shows half the roll bar 54 in cross-section. The hydraulic pump 50 has been removed to better illustrate the aspects of the roll bar 54. The roll bar 54 includes the attaching plate 90. The attaching plate 90 has a hole 88. The attaching plate 90 also includes fastener holes 215 through which fasteners 92 (as shown in FIG. 2) attach the attaching plate 90 to the base 52. The roll bar 54 also includes an inlet 214 as shown in FIG. 13. The inlet allows the fitting 204 as shown in FIG. 10 to pass through the inlet 214 and into the interior 212 of the roll bar 54. Cooling holes 96 are also illustrated. In some embodiments of the invention, the cooling holes 96 may be located as shown in the FIGS. In other embodiments the cooling holes 96 may be located at other locations on the roll bar 54. One of ordinary skill in the art after reviewing this disclosure would understand where to place the cooling holes 96 in order to achieve the goals of a particular application.

Figure 14:
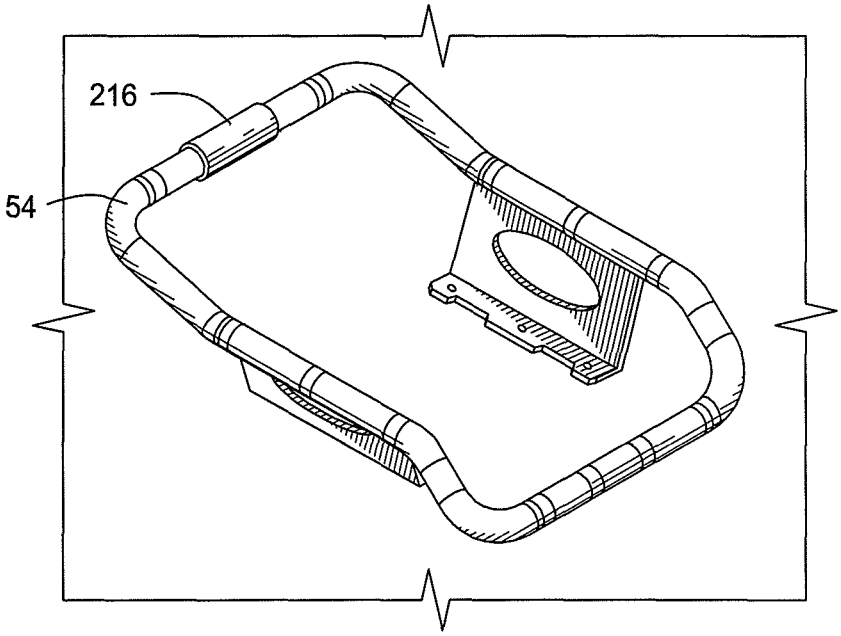
FIG. 14 is a perspective view of a roll cage used in some embodiments of the invention.

FIG. 14 illustrates the roll bar 54 from a perspective view. The hydraulic pump 50 has been removed to better illustrate aspects of the roll bar 54. In the embodiment shown in FIG. 14 the roll bar 54 is equipped with an external cooling control sleeve 216.

Figure 15:
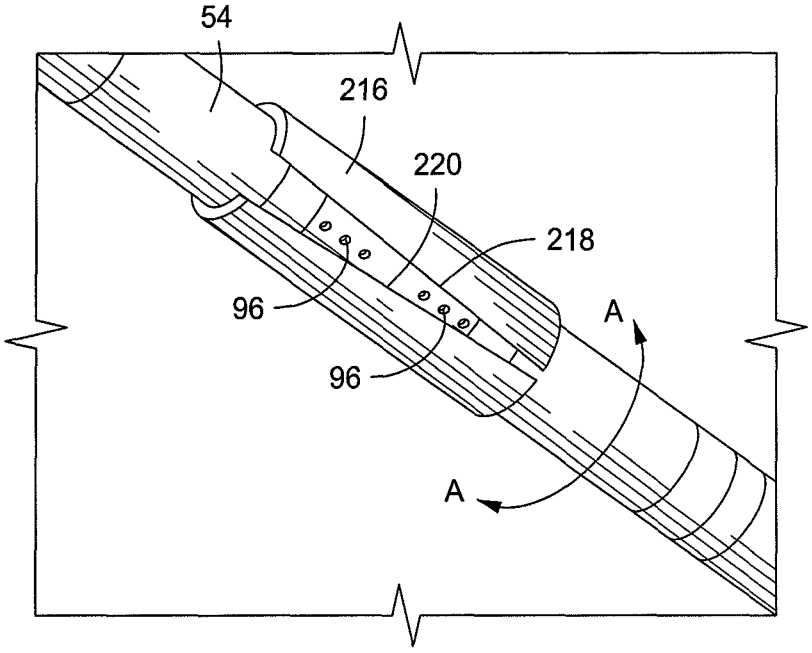
FIG. 15 is a perspective close up partial view of a roll cage used in some embodiments of the invention.
Figure 16:
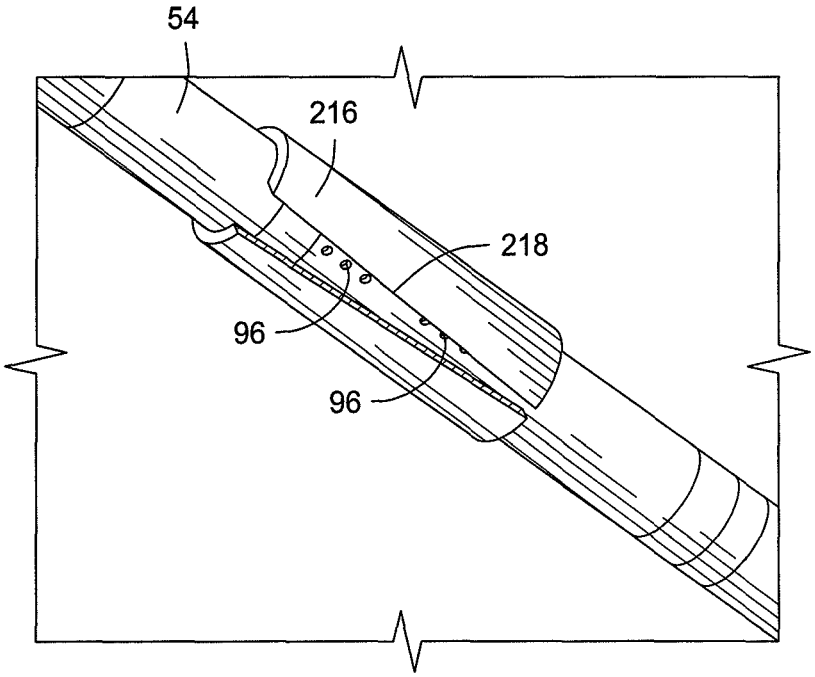
FIG. 16 is a perspective close up of a partial view of a roll cage used in some embodiments of the invention.
Figure 17:
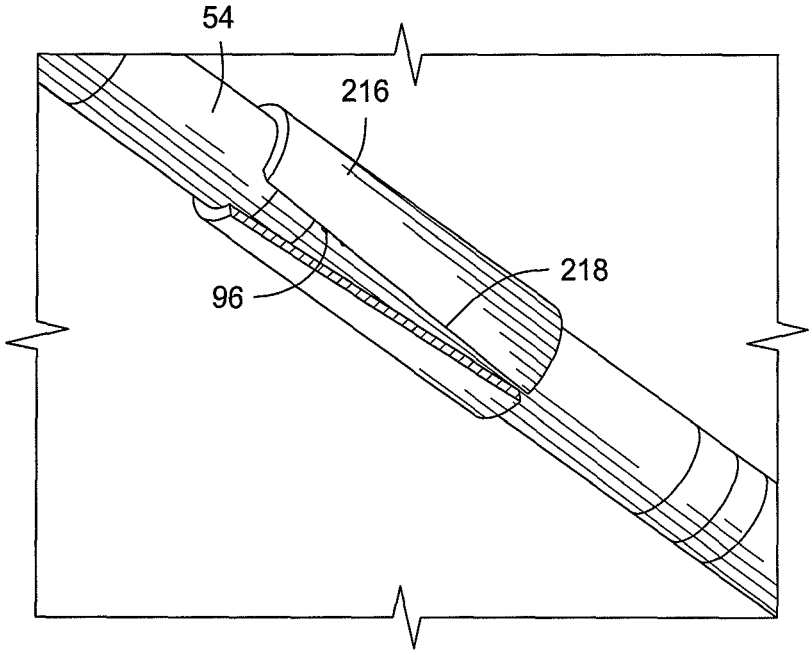
FIG. 17 is a perspective close up partial view of a roll cage used in some embodiments in accordance with the invention.
Figure 18:
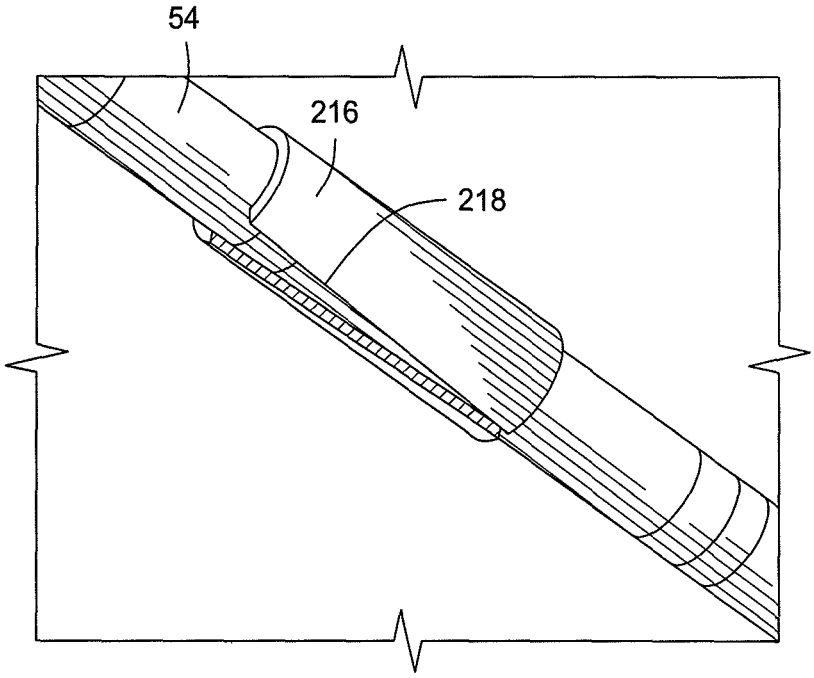
FIG. 18 is a perspective partial close up view of a roll cage used in some embodiments of the invention.

FIG. 15 is a partial close up view of the roll bar 54 and the external cooling control sleeve 216. The cooling control sleeve 216 is equipped with a slot 218. The slot 218 may have a taper 220. The external cooling control sleeve 216 can rotate either direction as shown by arrow A in FIG. 15. The external cooling control sleeve 216 is located so that the slot 218 is aligned with the cooling holes 96. The external cooling control sleeve 216 may be rotated on the roll bar 54 to selectively expose or conceal the cooling holes 96 as shown in FIGS. 16-18. The geometry of the slot 218 may vary in configuration with cooling holes 96 so that a desired controlled sequencing effect may be achieved.

In FIG. 16 some of the cooling holes 96 are partially concealed by the external cooling control sleeve 216 which has been rotated on the roll bar 54 so that the slot 218 is misaligned with the cooling holes 96 and conceals parts of the cooling holes 96.

In FIG. 17 the external cooling control sleeve 216 has been further rotated so that the slot 218 is further misaligned with the cooling holes 96. Some of the cooling holes 96 are completely covered by the control sleeve 216 while other cooling holes 96 are partially concealed the control sleeve 216.

As shown in FIG. 18 the cooling control sleeve 216 has been further rotated to completely conceal the cooling holes 96. As shown in FIG. 18 the slot 218 is completely misaligned with the cooling holes 96. The cooling control sleeve 216 can be rotated by user to vary the amount of cooling the cooling holes 96 apply to various components 78 of the hydraulic pump 50 by rotating the cooling control sleeve 216 on the roll bar 54.

Figure 19:
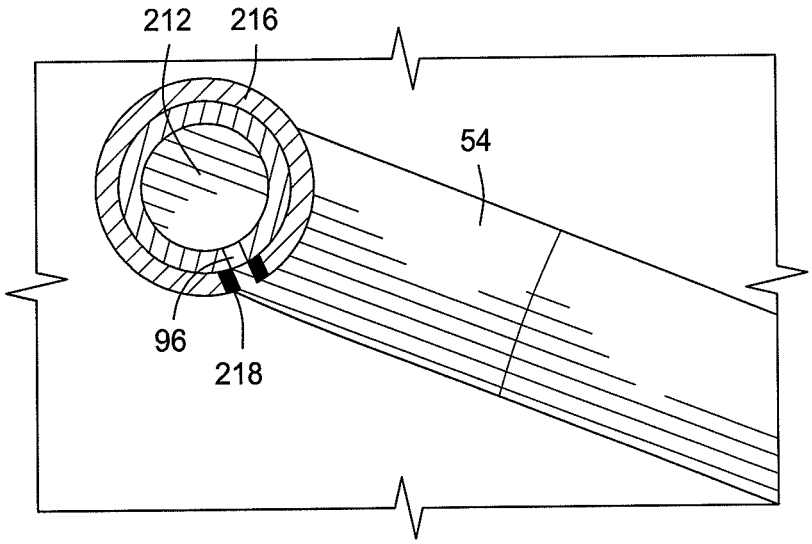
FIG. 19 is a partial cross sectional view of a roll cage used in some embodiments of the invention.
Figure 20:
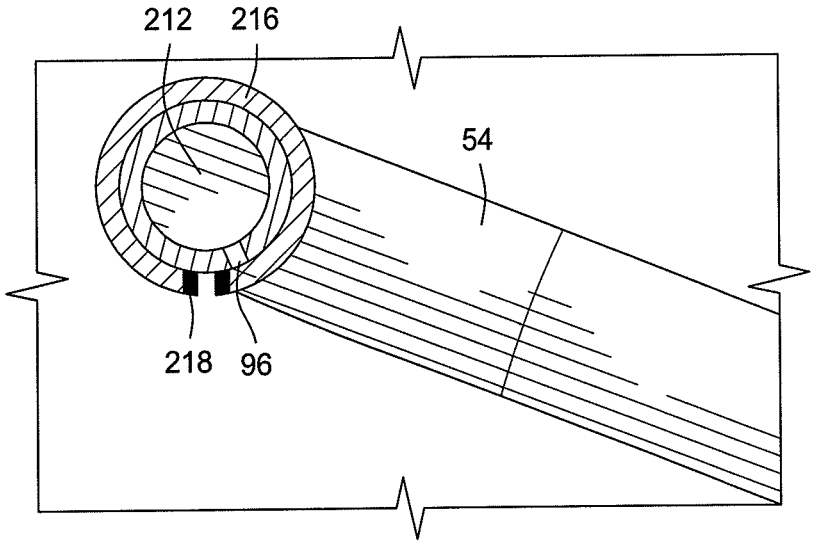
FIG. 20 is a partial cross sectional view of a roll cage used in some embodiments of the invention.

FIGS. 19 and 20 are a partial cross-sectional views of the roll bar 54 showing the external control sleeve 216 at various radial orientations. The slot 218 is aligned with the cooling holes 96 as shown in FIG. 19 and misaligned with the cooling holes 96 as shown in FIG. 20. When the cooling control sleeve 216 is oriented so that the slot 216 is aligned with the cooling holes 96 the air or fluid within the interior 212 of the role bar 54 is provided with a path to the outside of the roll bar 54. Therefore, the fluid within the interior 212 and the roll bar 54 cools the components 78 of the hydraulic pump 50.

In contrast, while the cooling control sleeve 216 is oriented so that the slot 218 is misaligned with the cooling holes 96 a pathway is not provided from the interior 212 of the roll bar 54 for the fluid within the interior 212 of the roll bar 54 to jet through the cooling holes 96 to cool the various components 78 of the hydraulic pump 50. As would be understood by one of ordinary skill in the art after reviewing this disclosure, intermediate positions between those shown in FIGS. 19 and 20 would allow reduced cooling to occur by partially constricting the flow path provided by the hole 96 when the holes are partially aligned with the slot 218. The taper 220 (as shown in FIGS. 15-18) provides additional advantages in allowing the cooling control sleeve 216 to provide intermediate amounts of cooling as desired by a user.

Figure 21:
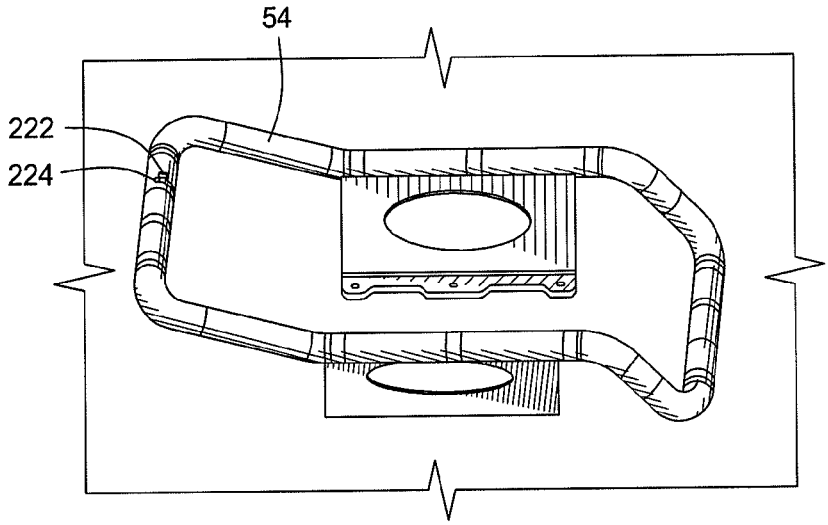
FIG. 21 is a perspective view of a roll cage used in accordance with some embodiments of the invention.

In other embodiments of the invention other adjustable means for allowing the control of the amount of cooling applied to the hydraulic pump 50 may be used. For example, in FIGS. 21-23 an adjustable means is described. In FIG. 21 the roll bar 54 is shown. The hydraulic pump 50 has been removed to better shown aspects of the roll bar 54. The roll bar 54 is equipped with a slot 224 through which a cooling control knob 222 extends.

Figure 22:
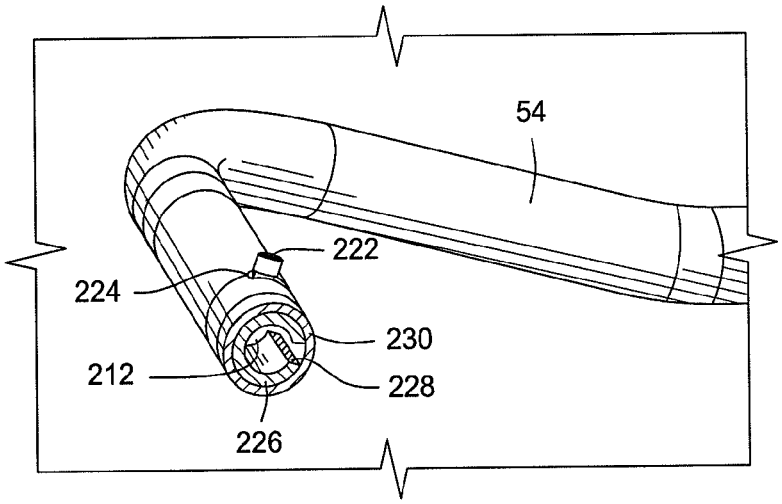
FIG. 22 is an enlarged cross-sectional view of a portion of a roll cage used in accordance with some embodiments of the invention.
Figure 23:
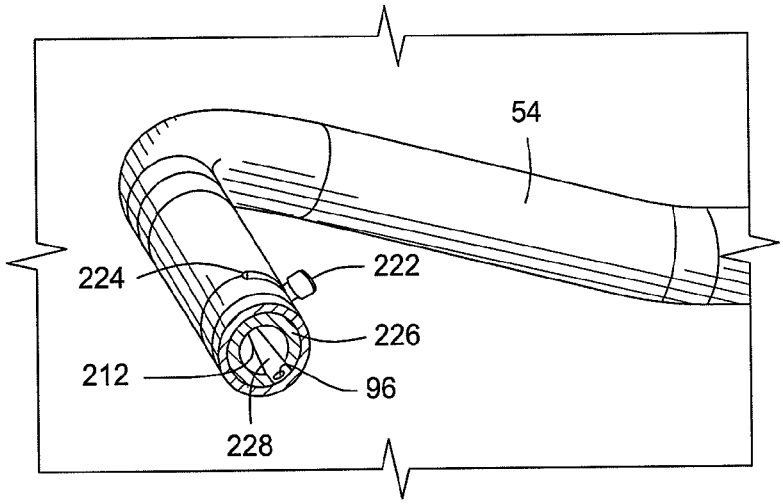
FIG. 23 is an enlarged cross-sectional view of a portion of a roll cage used in accordance with some embodiments of the invention.

FIG. 22 is a cross-sectional view of a portion of the roll bar 54 shown in FIG. 21. As shown in FIG. 22 an interior cooling control sleeve 226 is located within interior 212 of the roll bar 54. The interior control sleeve 226 is equipped with a slot 228. In accordance with some embodiments of the invention this slot 228 may have a taper 230. The interior cooling control sleeve 226 is attached to the control knob 222 which extends through the slot 224 of the roll bar 54. A user may rotate the control knob 222 through the slot 224 of the roll bar 54 which causes the interior cooling control sleeve 226 to rotate. Rotation of the interior cooling control sleeve 226 can cause the control slot 228 to selectively align with the cooling holes 96 similar to that described above with respect to FIGS. 14-20. The control knob 222 can be moved to various positions within the slot 224 to rotate the interior cooling control sleeve 226 to allow the control slot 228 to align, partially align, or complete misalign with the cooling holes 96. Moving the control knob 222 allows a user to control how much air or cooling fluid is permitted to flow from the interior 212 of the roll bar 54 to the components 78 of the hydraulic pump 50.

It will be understood that exhaust air may also be directed to locations that may not be on the pneumatic machine. For example, an area near the pneumatic machine may be desired to be cooled. The exhaust air may be directed to the area near the pneumatic machine.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A compressed gas powered machine comprising:

an outlet;

a hollow member fluidly connected to the outlet and configured to receive gas expended from the machine through the outlet, the hollow member defining holes oriented to allow the gas contained in the hollow member to blow on various parts of the machine; and a fitting configured to provide fluid communication between the hollow member and the outlet and the hollow member is a roll bar, wherein the fitting is configured to also provide gas from the outlet to a muffler.

2. The machine of claim 1, wherein the machine is a hydraulic pump.

3. The machine of claim 1, wherein the fitting is adjustable to vary the ratio of gas provided to the muffler and the hollow member.

4. The machine of claim 1, wherein the relative dimensions of the outlet and an interior chamber of the hollow portion are configured to allow pressurized gas from the outlet to expand and thereby cool in the chamber of the hollow portion.

5. The machine of claim 1, wherein the hollow member is flexible and may be wrapped around the machine by a user.

6. The machine of claim 1, wherein air at an outlet of the machine before it has entered the hollow member is at a pressure greater than ambient air pressure.

7. A compressed gas powered machine comprising:

an outlet;

a hollow member fluidly connected to the outlet and configured to receive gas expended from the machine through the outlet, the hollow member defining holes oriented to allow the gas contained in the hollow member to blow on various parts of the machine; and further comprising a fitting configured to provide fluid communication between the hollow member and the outlet and the hollow member is a roll bar, wherein the roll bar includes;

a bypass section; and a handle section configured to allow a user to move the machine by grabbing the handle section and exerting a force on the handle section wherein the bypass section is configured to have the gas flow through it.

8. The machine of claim 7, wherein the bypass section defines holes oriented to direct air on a desired location.

9. The machine of claim 7, wherein the machine is a hydraulic pump.

10. The machine of claim 7, wherein the relative dimensions of the outlet and an interior chamber of the hollow portion are configured to allow pressurized gas from the outlet to expand and thereby cool in the chamber of the hollow portion.

11. The machine of claim 7, wherein the hollow member is flexible and may be wrapped around the machine by a user.

12. A method of cooling a machine comprising:

outputting a compressed gas from the machine into a hollow member;

directing the gas to a desired location;

venting the gas onto the various components that are desired to be cooled; and bypassing the gas around a section of the hollow member configured to be a hand grip.

13. The method of claim 12, wherein the hollow member is a roll bar associated with the machine and further comprising forming holes in the roll bar oriented to direct the gas onto various components of the machine.

14. A method of cooling a machine comprising:

outputting a compressed gas from the machine into a hollow member;

directing the gas to a desired location;

venting the gas onto the various components that are desired to be cooled; and diverting some of the gas to flow into a muffler instead of the hollow member.

15. The method of claim 14, further comprising expanding and thereby cooling the gas in the hollow member.

16. The method of claim 14, further comprising running the machine with the compressed gas.

17. The method of claim 14, further comprising forming holes in the hollow member oriented to direct the gas onto various components of the machine.

18. The method of claim 14, wherein the gas is air.

19. The method of claim 14, wherein the hollow member is a flexible hose having holes and further comprising positioning the holes to direct the gas onto various parts of the machine or an article near the machine.

* * * * *